United States Patent [19]

Holmes

[11] Patent Number: 4,911,293

[45] Date of Patent: Mar. 27, 1990

[54] CLOSURE STRIP HAVING OFFSET PROTRUSIONS

[75] Inventor: Jack H. Holmes, Cowiche, Wash.

[73] Assignee: Kwik Lok Corporation, Yakima, Wash.

[21] Appl. No.: 309,276

[22] Filed: Feb. 10, 1989

[51] Int. Cl.[4] ..... B65D 77/10

[52] U.S. Cl. ..... 206/343; 24/30.5 R; 24/563; 206/390

[58] Field of Search ..... 206/343, 820, 342, 338; 24/30.5 S, 30.5 R, 561, DIG. 28, 563; 29/413, 414, 417

[56] References Cited

U.S. PATENT DOCUMENTS

| | | | |
|---|---|---|---|
| 712,422 | 10/1902 | Stokes | 206/343 X |
| 3,164,249 | 1/1965 | Paxton | 206/343 |
| 3,164,250 | 1/1965 | Paxton | 206/343 |
| 3,270,873 | 9/1966 | Paxton | 206/343 X |
| 3,270,874 | 9/1966 | Hilton | 206/343 |
| 4,026,413 | 5/1977 | Britt et al. | 206/343 |
| 4,333,566 | 6/1982 | Holmes | 206/343 |
| 4,341,303 | 7/1982 | Britt | 206/343 |
| 4,361,935 | 12/1982 | Paxton | 24/30.5 R |
| 4,509,231 | 4/1985 | Paxton | 24/30.5 R |

*Primary Examiner*—Bryon P. Gehman

*Attorney, Agent, or Firm*—Seed and Berry

[57] ABSTRACT

A multi-closure strip of generally flat, semirigid plastic closures which are jointed by sets of transversely spaced connecting material in which the connecting material is formed between smoothly rounded protrusions, each having an apex and a wider base. The connecting mateial is along a line generaly parallel or at a slight angle to the longitudinal axis of the multi-closure strip. A gap is provided between the transversely spaced sets of closure material so that, by the application of a lateral force, the connecting material is separated in tension as one closure moves laterally relative to the other.

6 Claims, 1 Drawing Sheet

CLOSURE STRIP HAVING OFFSET PROTRUSIONS

FIELD OF THE INVENTION

This invention pertains to closures formed of semi-rigid, flat, plastic material for holding closed the necks of flexible bags and to strips of such closures which can be separated by breaking the connections between adjacent closures in the strip.

DESCRIPTION OF THE PRIOR ART

Multi-closure strips of the type shown in U.S. Pat. Nos. 3,164,249; 3,164,250; and 4,333,566 are well known. These closures are generally made of flat, semi-rigid plastic. The closures are separated, preferably by an automatic machine, by breaking the connecting material which interconnects adjacent closures in the strip after the bag neck to be closed is pushed into the closure.

Occasionally, per the invention as described in U.S. Pat. No. 3,164,250, the machine for automatically applying and separating the closures will not break the straight connecting material between the closures cleanly, leaving an undesirable jagged tab protruding from the edge of the closure. Per the invention as described in U.S. Pat. No. 4,333,566, the round connecting material does break cleanly from both connected closures, leaving a residue of round pieces of plastic around the machinery. This has now become objectionable in some packaging operations because of the possibility of the plastic pieces getting into the product package under certain conditions.

It is also necessary that the connecting material in these strips of closures have sufficient strength such that the closures, when in strip form, will not prematurely break during handling, particularly when the closures in the strip are subjected to forces perpendicular to the plane of the closure. This type of bending can occur frequently because the strips are stored in large coils and, during handling, the closures are subjected to bending in the plane perpendicular to the plane of the closure.

Thus, two of the desired features of a satisfactory strip of semirigid plastic closures are that they be able to be handled and not break prematurely, and, when separated, will separate cleanly without leaving a jagged tab.

SUMMARY OF THE INVENTION

It is an object of this invention to provide an improved multi-closure strip in which the closures, when machine applied, are broken from the strip, leaving no residue behind. Through many tests, it has been shown that the most effective way to separate the connected closures is by using tensile force.

It is another object of this invention to provide a multi-closure strip of flat, rigid plastic closures which can be bent in a direction perpendicular to the plane of the strip or otherwise handled without prematurely separating the closures from the strip but which will break cleanly when separated.

Basically, these objects are obtained by providing the closures in end-to-end connecting array, with protrusions extending from the ends of the adjacent closures. Two sets of protrusions extend from each end of a closure with the protrusions of each set being transversely spaced from one another. The confronting protrusions of adjacent closures are connected together with common connecting material. The separating juncture of the connecting material between the protrusions is along a line generally parallel or at a slight angle to the longitudinal axis of the strip of closures. A minimal central gap is provided between the transversely spaced protrusions in each set so that by the application of a force lateral to the lengthwise axis of the closure strip, and in the plane of the flat plane of the strip, the connecting material is separated by tensile stress as one closure moves laterally relative to the other.

In the preferred form of the invention, each protrusion extends smoothly in a rounded shape having a wide base and a narrower outer apex to provide the necessary structure to transfer the separating force to the connecting material. The connecting material is approximately midway between the base and the apex of each protrusion.

DETAILED DESCRIPTION OF THE INVENTION

Figure 1:
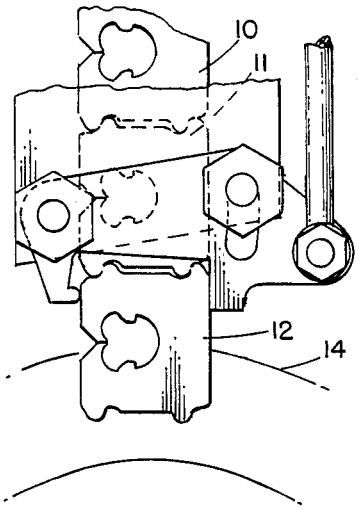
FIG. 1 is a fragmentary plan view of a multi-closure strip embodying the principles of the invention.

The figures show a portion of a multi-closure strip of generally flat, semirigid, plastic closures, with only the endmost closures 10, 11 and 12 being illustrated. It is understood, however, that these closures generally come in an elongated strip stored in a coil, with the axis of the coil being generally right to left, as shown in FIG. 1 of the drawing.

Figure 2:
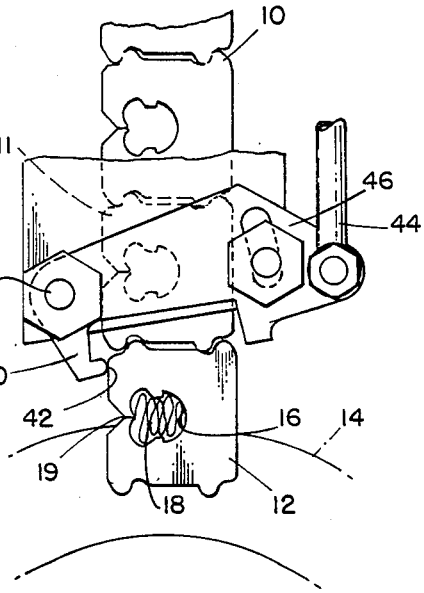
FIG. 2 is a fragmentary plan view of a multi-closure strip embodying the principles of the invention, with a breaking implement shown shifting the endmost closure laterally relative to the next closure of the strip.

Bags whose necks are to be held closed by the closures generally travel along line 14 and become gathered into the bag neck receiving opening 16 of the closure, as illustrated by the wavy lines 18 in FIG. 2.

Each closure has a bag neck receiving opening 16 and a bag access opening 19.

Figure 3:
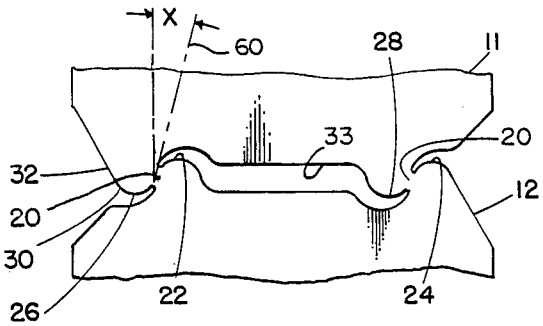
FIG. 3 is an enlarged detail of the closure strip showing the connecting material positioned between the protrusions of adjacent closures.

The adjacent closures are interconnected by interconnecting material 20 between two sets of transversely spaced protrusions 22 and 24, and 26 and 28. Each protrusion is substantially identical and includes an apex 30 and a wider base 32, with the apex being rounded as shown in FIG. 3. The protrusions are separated by a gap or punched-out opening 33.

Also as best shown in FIG. 3, the connecting material 20 is along a line 60 generally parallel to the longitudinal axis of the strip. A slight deviation from actual parallelism of about 15 degrees (as shown by the letter "X") has been found to be preferred, although lesser degrees are also satisfactory.

A closure strip of the type identified is easily broken by a pusher 40 having a rounded tip 42. The pusher is moved by a member 44 which causes a link 46 connected to the pusher 40 to pivot about an axis 48.

As best shown in FIG. 2, the lateral motion of the pusher 40 pushes closure 12 laterally to the right relative to closure 11. This causes the connecting material to receive a tensile breaking stress since the protrusions 22 and 24 are pulled away from protrusions 26 and 28.

It has been found that by producing a tensile breaking stress, separation will be effected without leaving any residue.

While the preferred embodiment of the invention has been illustrated and described, and while other alternatives will be apparent, it should be understood that other variations will be apparent to one skilled in the art without departing from the principles herein. Accordingly, the invention is not to be limited to the exact configuration illustrated in the drawing.

I claim:

1. In a multi-closure, end-to-end strip of semirigid, plastic closures wherein the closures each have a side-edge, bag-neck access opening joining a bag-neck receiving opening, said closures being joined together in a strip by connecting material between the ends of adjacent closures, the ends of each closure having protrusions extending parallel to the longitudinal axis of the strip, the connecting material having two portions separated transversely by a gap between the ends of adjacent closures, each portion being defined by the protrusions of the ends of the closures, the protrusions of the end of one closure being transversely offset from and logitudinally overlapping the protrusions of the adjacent closure, with the connecting material being along a line generally parallel to the longitudinal axis of the strip and within the overlap of the protrusions of adjacent closures, whereby lateral movement of the endmost closure relative to the adjacent closure will fracture the connecting material between the overlapping protrusions in tension, leaving the protrusions unconnected.

2. The strip of claim 1, said line of connecting material being along a line about 15 degrees from the longitudinal axis of the strip.

3. The strip of claim 2, said protrusions each being smoothly curved and having a base and an apex, said connecting material lying approximately midway between the apex and the base.

4. The strip of claim 1, said protrusions each being smoothly curved and having a base and an apex, said connecting material lying approximately midway between the apex and the base.

5. A multi-closure strip of semirigid, thin plastic closures, said closures each having an access opening on a side-edge thereof communicating with a bag-neck receiving opening, means connecting said closures in said strip for separation by tensile fracture by movement of the endmost closure laterally in one direction in the plane of said closure relative to the longitudinal axis of the strip and the adjacent closure, wherein said connecting means includes a set of transversely spaced, smooth protrusions on each closure, the protrusions of the set extending from a common end of the closure, the opposed protrusions of each adjacent closure overlapping in the longitudinal direction of the strip and being interconnected by connecting material within the overlap of the protrusions and forming an elongated gap between adjacent closures, said set of protrusions of the endmost closure being offset transversely in the plane of the closures in the direction downstream in said lateral movement relative to the set of protrusions on the adjacent closure to which it is connected.

6. The strip of claim 5, said connecting material lying along a line about 15 degrees from a line parallel to the longitudinal axis of the strip.

* * * * *